US005095665A

United States Patent [19]

Nagata et al.

[11] Patent Number: 5,095,665

[45] Date of Patent: Mar. 17, 1992

[54] VITRIFIED SUPER ABRASIVE GRAIN GRINDING TOOL

[75] Inventors: Akira Nagata, Tsu; Takao Yogo, Nagoya, both of Japan

[73] Assignee: Noritake Co., Limited, Nagoya, Japan

[21] Appl. No.: 367,510

[22] Filed: Jun. 16, 1989

[30] Foreign Application Priority Data

Jun. 16, 1988 [JP] Japan ..... 63-146752

[51] Int. Cl.[5] ..... B24D 3/02

[52] U.S. Cl. ..... 51/307; 51/308; 51/309

[58] Field of Search ..... 51/307, 308, 309

[56] References Cited

U.S. PATENT DOCUMENTS 3,592,618 7/1971 Alden ..... 51/307
4,381,925 5/1983 Celleselli ..... 51/308
4,500,325 2/1985 Huber et al. ..... 51/307
4,711,644 12/1987 Yeckley et al. ..... 51/307
4,761,163 8/1988 Messere ..... 51/307
4,842,619 6/1989 Fritz et al. ..... 51/307

*Primary Examiner*—William R. Dixon, Jr.
*Assistant Examiner*—Willie J. Thompson
*Attorney, Agent, or Firm*—Fish & Richardson

[57] ABSTRACT

Vitrified super abrasive grain grinding tool comprised of abrasive grains and first and second fillers bonded together by a vitrified bonding material, wherein the abrasive grains are super abrasive grains, the softening points of the first and second fillers are both higher than an inherent firing temperature of the vitrified bonding material for the super abrasive grains, the first filler is a ceramics which maintains a hollow state before and after firing of the bonding material, and the second filler is a ceramics which exists in a non-hollow state. This grinding tool has a high porosity at a low concentration while utilizing excellent grinding characteristic of super abrasive grains with high grain retention force and little burn mark in dry grinding.

27 Claims, 2 Drawing Sheets

VITRIFIED SUPER ABRASIVE GRAIN GRINDING TOOL

FIELD OF THE INVENTION

This invention relates to a vitrified grinding tool (wheel) in which abrasive grains are bonded by a vitrified bonding material, and more particularly, to a vitrified super abrasive grain grinding tool using super abrasive grains as abrasive grains.

BACKGROUND

There is a vitrified grinding tool in which pores are formed by using an organic pore-forming agent. In this kind of vitrified grinding tool, however, there is the problem that retention force of abrasive grains decreases since the pore-forming agent is removed during firing.

On the other hand, in the case of a super abrasive grain grinding tool having a low concentration, it is conventional to admix an inorganic abrasion-resistive material from an economical viewpoint. In this case, however, since the abrasion-resistive material is worn out by abrasion to offer problems to grinding depending upon certain grinding conditions, it becomes necessary to frequently perform conditioning, and advantages as a vitrified super abrasive grain grinding tool cannot sufficiently be utilized under such a situation.

Consequently, there has been disclosed a vitrified grinding tool in which an inorganic hollow substance is used as a material for forming pores, and which has a superporous structure capable of simplifying conditioning without decreasing the retention force of abrasive grains (Japanese Patent Kokai Publication No. 62-251077 (1987). However, although this grinding tool is effective without the range of up to 45-55% by volume for the content of the inorganic hollow material in raw material composition, there is a danger of a decrease in the retention force of abrasive grains and a decrease in the surface finish of a work to be processed, if the content of the inorganic hollow material is increased in order to produce a grinding tool having a further lower concentration or more porous property.

SUMMARY OF THE DISCLOSURE

Under such a technical background, it is an object of the present invention to develop a vitrified super abrasive grain grinding tool which can sufficiently utilize meritorious characteristics of super abrasive grains, and especially maintain surface finish of the work to be processed at a high level, and in which the retention force of the abrasive grains is not decreased, and easy conditioning is possible.

After having performed various investigations in order to change the structure of a vitrified super abrasive grain grinding tool, especially with respect to those having a low concentration, the present inventors have achieved extremely excellent results when specific fillers are contained, and therefore propose the present invention. That is, the present invention solves the above-described problems by the following means.

According to the present invention, there is provided a vitrified super abrasive grain grinding tool comprised of abrasive grains and first and second fillers bonded together by a vitrified bonding material, wherein the abrasive grains are super abrasive grains, the softening points of the first and second fillers are both higher than an inherent firing temperature of the vitrified bonding material for the super abrasive grains, the first filler is a heat resistant hollow grain ceramic which maintains a hollow state before and after firing of the bonding material, and the second filler is a solid ceramic material which exists in a non-hollow state.

In the vitrified super abrasive grain grinding tool of the present invention, the following effects are provided because of having the features as described above.

1) Since there exist the first and second fillers, it is possible to obtain a grinding tool having an arbitrary porosity (especially a high porosity) at a low concentration while utilizing an excellent grinding characteristic of super abrasive grains.

2) Since pores are formed in the grinding tool due to the presence of the first filler, uniformly dispersed fine pores despite of a high porosity are formed, and it is possible to suppress a decrease in the retention force of super abrasive grains according to shrinkage at firing, compared with a case of pore formation only by a pore-forming agent. Furthermore, conditioning becomes extremely easy, or unnecessary in some cases, and it is also possible to provide a grinding tool causing little burn mark while being used, even compared with a case in which only the second filler is used. Accordingly, the grinding tool of the present invention is especially useful in grinding in which burn marks are easily generated, for example, in dry grinding.

3) Due to the presence of the second filler, decrease in the retention force of the abrasive grains can be suppressed as much as possible especially in a grinding tool having a low concentration or porous property, compared with a case of using the first filler alone, and it is possible to provide an increase in grinding ratio and an improvement in surface finish of a substance to be processed.

BRIEF DESCRIPTION OF THE DRAWINGS

FIG. 1 illustrates a relationship between stock removal and grinding ratio;

FIG. 2 illustrates a relationship between stock removal and electric power consumption;

FIG. 3 illustrates a relationship between stock removal and surface finish; and FIG. 4 illustrates dressing ratios.

DESCRIPTION OF THE PREFERRED EMBODIMENTS

Figure 1:
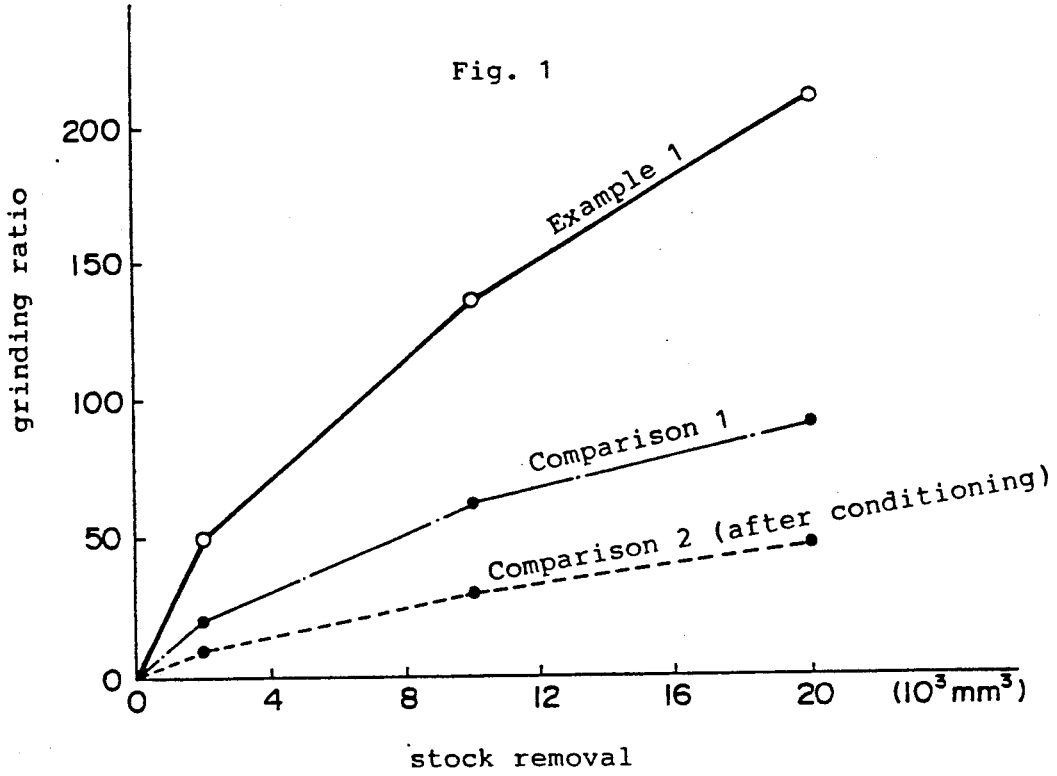
FIGS. 1 through 4 are graphs showing the results of investigating grinding characteristics and conditioning characteristics of grinding wheels of Example 1 and Comparative Examples 1 and 2.

A vitrified super abrasive grain grinding tool (wheel) of the present invention especially aims at that having a low concentration and a high porosity. This is for the purpose of providing a super abrasive grain grinding tool of general applicability utilizing a high grinding characteristic of super abrasive grains, while extremely reducing use (i.e. the amount) of super abrasive grains which are extremely expensive compared with general abrasive grains. The concentration of abrasive grains may be 5-less than 100, more preferably 25-75. Porosity may be 35%-70%, more preferably 40%-60. This porosity includes both that (referred to as "intergranular pores") produced in the intergranular space, i.e., among grains and as void of the bonding material due to volatilization etc., of an ordinary pore-forming agent (for example, volatile organic substances such as naphthalene, resin powder and the like), and that due to the presence of the first filler, since the first filler exists under a hollow state within the grinding tool. The super abrasive grains indicate super-hard abrasive grains, such as CBN or diamond abrasive grains and the like, and may also be a mixture of these abrasive grains in some cases. The super abrasive grains preferably have a Knoop hardness substantially greater than 3000 $kg/mm^2$. The grain size of abrasive grains can be properly selected in accordance with an object of application. It may, for example, be within the range of #60–#3000 in the case of precision grinding or super-precision grinding. As the vitrified bonding material, a material which is suitable when super abrasive grains are used as abrasive grains may be used, for example, a glass of a borosilicate-glass system or a lead-borosilicate-glass system. A crystallized (or crystallizable) glass may also be used. There are, for example, those disclosed in Japanese Patent Kokoku Publication No. 52-27394 (1977). It is possible to properly select the ratio of the bonding material, it may, for example, be within the range of 15–35% of the grinding tool.

The vitrified super abrasive grain grinding tool of the present invention must contain the first and second fillers. This is because, even in the case of a low concentration or a high porosity, the tool must be excellent in grinding characteristic, the retention force of abrasive grains must be within a proper range, and conditioning must be easy or unnecessary. The first and second fillers may be contained 25–80% altogether relative to raw material composition (volume %), and more preferably 30–60%. The softening points of the first and second fillers must be both higher than the inherent firing temperature of the vitrified bonding material for super abrasive grains. This is for the purpose of preventing a bad influence on the retention force of abrasive grains and the like due to firing of the bonding materials. The inherent firing temperature of the vitrified bonding material for super abrasive grains (termed hereinafter as "super vitrified firing temperature") indicates the most suitable firing temperature range for the bonding material when super abrasive grains are used as the abrasive grains and a vitrified bonding material is used as the bonding material. The super vitrified firing temperature is lower than the inherent firing temperature of the vitrified bonding material when general abrasive grains are used as abrasive grains, and is a firing temperature within the range of 650° C.–1000° C. (and more preferably 700° C.–950° C.). When the firing temperature exceeds the upper limit, deterioration occurs in the super abrasive grains, and when the firing temperature is less than the lower limit, a sufficient strength can not be obtained. More concretely, an appropriate firing temperature is selected in accordance with the kind of the vitrified bonding material to be used. The softening points of the first and second fillers is higher than the super vitrified firing temperature preferably by not less than 50° C., more preferably by not less than 100° C. Concretely, the softening point of the first filler is preferably not less than 700° C., and more preferably not less than 1000° C. The situation is the same for the second filler.

The first filler consists of a heat resistant hollow grain ceramic which maintains a hollow state before and after firing of the bonding material (i.e., firing of the grinding tool). By changing its content, it is possible to easily adjust the porosity of the grinding tool, particularly provide a high porosity, make conditioning easier or unnecessary in conjunction with the presence of the vitrified bonding material, and prevent the occurrence of burn mark of the grinding tool. Its content (raw material composition, volume %) may be 1–55%, more preferably 10–35%.

As examples for the first filler, there are the following materials (the softening point is shown in the parenthesis).

| | |
|---|---|
| Glass balloon | (1000° C.) |
| "Sirasu" balloon | (900° C.) |
| Carbon balloon | (900° C.) |
| Alumina balloon | (1500° C.) |
| Fly ash balloon | (1300° C.) |

Considering the reactivity with the bonding material and the maintainability of the hollow state, the glass balloon, the Sirasu balloon and the fly ash balloon are preferable, particularly the fly ash balloon is the most suitable material.

The diameter and wall thickness of the first filler are preferably such that the filler is not easily destroyed while grinding to hinder its self-sharpening (i.e., yielding fresh, sharp grain surface through releasing of grains upon grinding procedure). The coefficient of thermal expansion ($\alpha$) of the first filler is preferably nearly identical to that of the vitrified bonding material so that cracks are not generated in bridges of the bonding material due to an intergranular stress. It may, for example, be within the range of $\pm 2\times 10^{-6}K^{-1}$ (within the range of room temperature–500° C.) relative to the $\alpha$ of the super abrasive grains. The fly ash balloon is the most suitable material since its coefficient of thermal expansion is close to that of the super abrasive grains and the vitrified bonding material. The grain size of the first filler is preferably about ½–2 times, more preferably nearly coincide with the average grain size of the super abrasive grains. Pearlite which is a porous material may also be applied as the first filler, but the balloon which is a hollow material is more preferable.

The second filler consists of a solid ceramic material which exists in a non-hollow state. Its presence makes it possible to provide a grinding tool having a low concentration while utilizing an excellent grinding characteristic of the super abrasive grains. and a decrease in the retention force of the grinding tool can also be suppressed as much as possible. The content (raw material composition, volume %) of the second filler may be 5–35%, more preferably 9–30%.

The heat resistance (or softening point) of the second filler is preferably not less than 700° C., more preferably not less than 1000° C. This is for the purpose of preventing variation and change in quality due to cracks by transformation, fushion, dissolution into the bonding material and the like of the second filler during the firing (sintering). Even if the heat resistance is not less than 700° C., a material having a strong basic property (for example, MgO, CaO and the like containing substantial amount of those) is not suitable, since it is dissolved into the vitrified bonding material due to its reactivity to change the property of the bonding material itself.

As examples for the second filler, there are ceramics, such as $Al_2O_3$ system, $SiO_2$—$Al_2O_3$ system, SiC system, zircon, cordierite and the like.

As in the case of the first filler, the coefficient of thermal expansion ($\alpha$) of the second filler is also preferably is nearly identical to that of the vitrified bonding material so that cracks are not generated in bridges of the bonding material due to the intergranular stress. It should, for example, be within the range of $\pm 2\times 10^{-6}K^{-1}$ (within the range of room temperature-500° C.) relative to the α of the super abrasive grains. Mullite which is a silica-alumina ceramics and SiC have properties relatively close to this requirement, and hence are suitable materials. The grain size of the second filler is preferably about 1/5-2 times, more preferably nearly identical to the average grain size of the super abrasive grains.

The most suitable combination of the first and second fillers is as follows. That is, 25-35% by volume (raw material composition) of a fly ash balloon having a grain size nearly identical to that of the super abrasive may be used as the first filler, and 10-25% by volume (raw material composition) of SiC having a grain size identical to that of the super abrasive grains may also be used as the second filler. It is thereby possible to obtain a grinding tool which produces no burn mark while being used for dry grinding and has an excellent surface finish of a processed work.

A preferred composition for the for the vitrified bonding material is as follows (on the basis of weight).

| | |
|---|---|
| $SiO_2$ | 40-60% |
| $Al_2O_3$ | 2-14% |
| $B_2O_3$ | 9-25% |
| $P_2O_3$ | 1-8% |
| RO | 3-14% |
| $R_2O$ | 2-4% |
| $ZrO_2$ | 2-20% |

In the above-described composition, RO indicates at least one kind of oxides selected from the group consisting of CaO, MgO and BaO, and $R_2O$ indicates at least one kind of oxides selected from the group consisting of $Li_2O$, $Na_2O$ and $K_2O$.

Other than the first and second filler, conventional or usual additives generally used in a vitrified super abrasive grain grinding tool, for example, an embrittling agent or a solid lubricant, may also be contained in a proper amount, if desired. Furthermore, a forming (shaping) aid (temporary binder at the green state such as organic binder serving us a paste and the like) or a pore-forming agent may also be additionally used while producing.

The vitrified super abrasive grain grinding tool according to the present invention is required to have the above-described structure at least in the portion which takes part in the grinding in contact with the work. For example, a unit of the super abrasive grain grinding tool concerned may be provided on the surface of a support member which may be of diverse modification.

The vitrified grinding tool of the present invention is suitable for the grinding of high-precession parts, and especially has a significant effect in dry grinding, such as grinding of a metal mold, die and the like.

EXAMPLES

The present invention will be hereinafter further elucidated with reference to embodiments.

EXAMPLE 1

CBN Abrasive Grain: Concentration 50

| | |
|---|---|
| CBN abrasive grain (# 140/170) | 17 volume parts |
| Fly ash balloon (90-115 μm) (1st filler) | 42 volume parts |
| SiC (90 μm-115 μm) (2nd filler) | 17 volume parts |
| Vitrified bonding material | 24 volume parts |
| Forming aid | 6 volume parts |

COMPARATIVE EXAMPLE 1

CBN Abrasive Grain: Concentration 50

| | |
|---|---|
| CBN abrasive grain (# 140/170) | 17 volume parts |
| Fly ash balloon (90-115 μm) | 59 volume parts |
| Vitrified bonding material | 24 volume parts |
| Forming aid | 6 volume parts |

COMPARATIVE EXAMPLE 2

CBN Abrasive Grain: Concentration 50

| | |
|---|---|
| CBN abrasive grain (# 140/170) | 17 volume parts |
| Fused mullite (90-115 μm) | 59 volume parts |
| Vitrified bonding material | 24 volume parts |
| Forming aid | 6 volume parts |

Samples in compositions according to the above-described Example 1, and Comparative Examples 1 and 2 were subjected to press forming, and fired at 900° C. for 5 hours to prepare grinding wheels having an outer diameter of 180 mm, a thickness of 10 mm and a center bore diameter of 31.75 mm. The grinding wheels were then subjected to surface grinding, and grinding characteristics, that is, (a) grinding ratio, (b) electric power consumption, (c) dressing ratio and (d) surface finish of works. The results are shown in FIGS. 1 through 4. The grinding conditions and dress conditions are as follows.

Grinding Conditions

| | |
|---|---|
| Machine used | Surface grinder |
| Grinding method | Dry plunge grinding |
| Peripheral velocity of grinding wheel | 1600 m/min |
| Table-feeding rate | 25 m/min |
| Depth of cut | 5 μm/pass |
| Work | SKD 11 ($H_{RC}$ 61) |
| Dimensions of the work | 100 mm long × 5 mm wide |

Dress Conditions

| | |
|---|---|
| Dress tool | Single-stone diamond (½ t) |
| Dress-feeding lead | 0.2 mm/rev. of wheel |
| Depth of cut | R 5 μm/pass × 10 pass |

Figure 3:
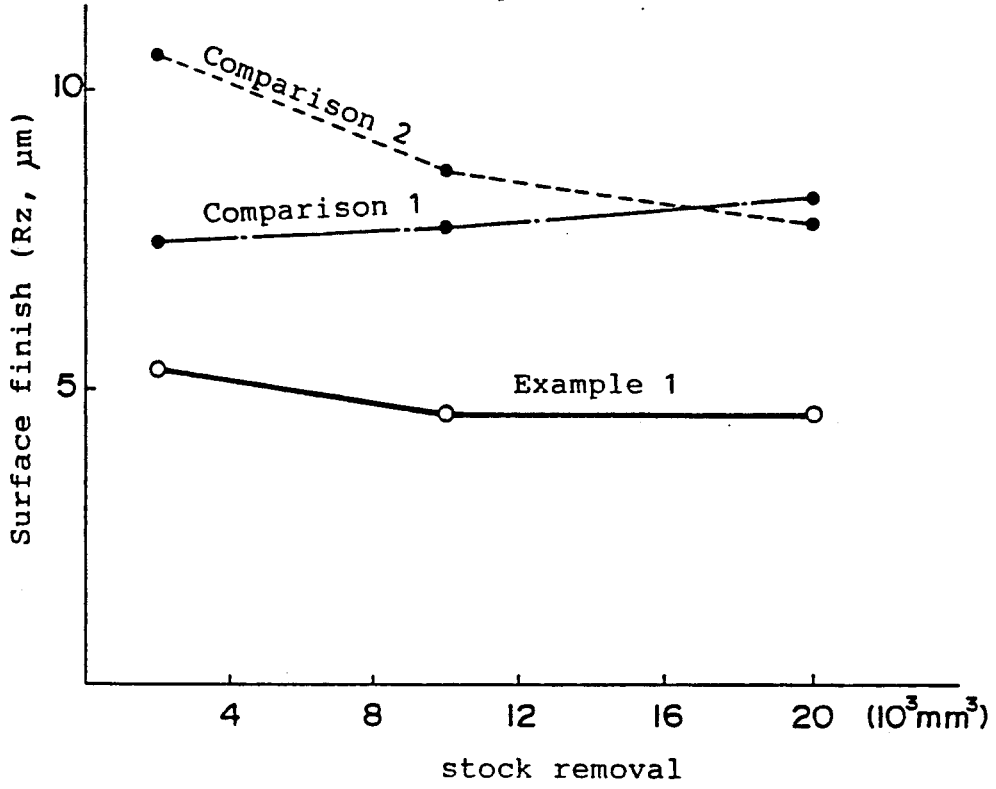

It can be understood that the grinding wheel of Example 1 has a higher grinding ratio, and the surface finish of the work is significantly excellent (FIGS. 1 and 3).

Figure 2:
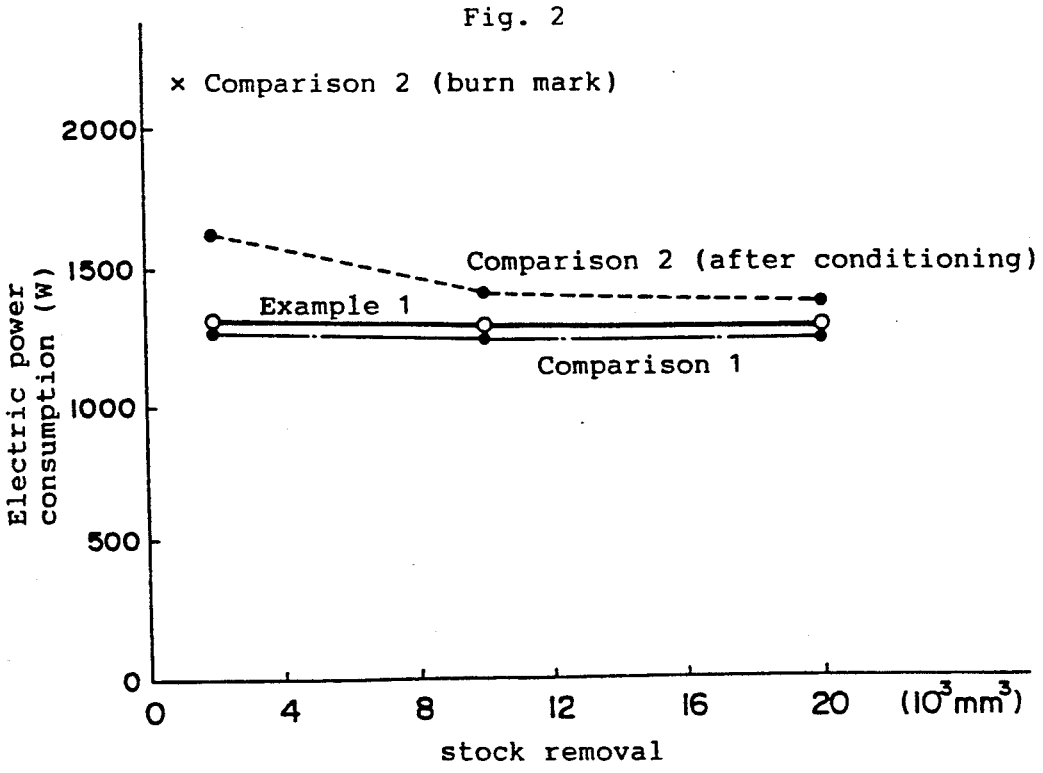
Figure 4:
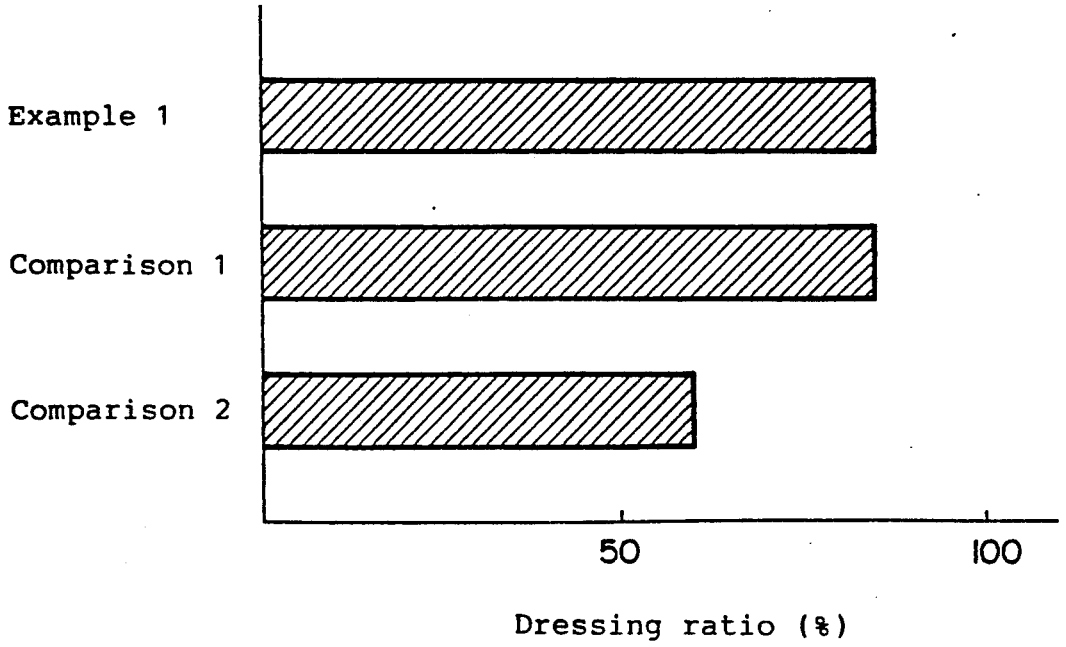

In the grinding wheel of Comparative Example 2, burn mark (scorching) occurred when the conditioning was not performed (FIG. 2). In contrast thereto, the grinding wheel of Example 1 can be used without performing conditioning. Furthermore, the grinding wheel of Example 1 has a smaller electric power consumption and a higher grinding ratio even compared with the grinding wheel of Comparative Example 2 which was subjected to the conditioning, and shows an excellent grinding performance (FIGS. 1 and 2 ). Also as for the dressing characteristic, it can be understood that the grinding wheel of Example 1 is better than that of Comparative Example 2 (FIG. 4).

It should be understood that the modification may be done in the art without departing from the gist and scope of the present invention as herein disclosed and hereinbelow claimed.

What is claimed is:

1. A vitrified super abrasive grain grinding tool comprising super abrasive grains and first and second fillers bonded together by a vitrified bonding material, wherein the softening points of the first and second fillers are both higher than an inherent firing temperature of the vitrified bonding material for the super abrasive grains, the first filler is a heat resistant hollow grain ceramic material which maintains a hollow state both before and after firing of the vitrified bonding material, and the second filler is a solid ceramic material which exists in a non-hollow state.

2. The vitrified super abrasive grain grinding tool according to claim 1, wherein and inherent firing temperature is within the range of 650°-1000° C.

3. The vitrified super abrasive grain grinding tool according to claim 1, wherein the first filler is at least one selected from the group consisting of a glass balloon, a Sirasu balloon, a carbon balloon, an alumina balloon, a fly ash balloon, and a mixture thereof.

4. The vitrified super abrasive grain grinding tool according to claims 1, 2 or 3, wherein the second filler is at least one selected from the group consisting of alumina, SiC, an $SiO_2$—$Al_2O_3$—system ceramic, zircon, cordierite or a mixture thereof.

5. The vitrified super abrasive grain grinding tool according to claim 1, wherein the coefficients of thermal expansion ($\alpha$) of the first filler and the second filler are within the range of $\pm 2\times 10^{-6}\,K^{-1}$ within a range of room temperature-500° C. relative to the $\alpha$ of the super abrasive grains.

6. The vitrified super abrasive grain grinding tool according to claim 1, wherein the concentration of the abrasive grains is 5 to less than 100.

7. The vitrified super abrasive grain grinding tool according to claim 1, wherein the grinding tool has a porosity of 35-70%.

8. The vitrified super abrasive grain grinding tool according to claim 6, wherein the concentration of the abrasive grains is 25-75.

9. The vitrified super abrasive grain grinding tool according to claim 7, wherein the porosity is 40-60%.

10. The vitrified super abrasive grain grinding tool according to claim 1, wherein the first filler is 1-55% by volume, and the second filler is 5-35% by volume of the material composition, respectively.

11. The vitrified super abrasive grain grinding tool according to claim 10, wherein the first filler is 10-35% by volume, and the second filler is 9-30% by volume of the material composition, respectively.

12. The vitrified super abrasive grain grinding tool according to claim 1, wherein the first filler is 25-35% by volume, and the second filler is 10-25% by volume of the material composition, respectively.

13. The vitrified super abrasive grain grinding tool according to claim 1, wherein the first and second filler is present in total 25-80% by volume of the material composition.

14. The vitrified super abrasive grain grinding tool according to claim 13, wherein the first and second filler is present in total 30-60% by volume of the material composition.

15. The vitrified super abrasive grain grinding tool according to claim 7, wherein the porosity is 40-60%.

16. The vitrified super abrasive grain grinding tool according to claim 1, wherein the inherent sintering temperature of the vitrified bonding material is 700°-950° C.

17. The vitrified super abrasive grain grinding tool according to claim 4, wherein the second filler is an $SiO_2$—$Al_2O_3$—system ceramic SiC, or a mixture thereof.

18. The vitrified super abrasive grain grinding tool according to claim 1 wherein the first filler has a softening point which is at least 50° C. higher than the inherent sintering temperature of said vitrified bonding material.

19. The vitrified super abrasive grain grinding tool according to claim 18, wherein the first filler has a softening point of 700° C. or above.

20. The vitrified super abrasive grain grinding tool according to claim 19, wherein the first filler has a softening point of 1000° C. or above.

21. The vitrified super abrasive grain grinding tool according to claim 3, wherein the first filler is fly ash balloon and the second filler is SiC.

22. The vitrified super abrasive grain grinding tool according to claim 1, wherein the first filler has an average grain size of ½-2 of that of the super abrasive grains.

23. The vitrified super abrasive grain grinding tool according to claim 22, wherein the second filler has an average grain size of 1/5-2 of that of the super abrasive grains.

24. The vitrified super abrasive grain grinding tool according to claim 1, wherein the first and second fillers have an average grain size substantially equal to that of the super abrasive grains.

25. The vitrified super abrasive grain grinding tool according to claim 2, wherein the second filler has a softening point of not less than 700° C.

26. The vitrified super abrasive grain grinding tool according to claim 2, wherein the second filler has a softening point of not less than 1000° C.

27. The vitrified super abrasive grain grinding tool according to claim 25, wherein the second filler does not contain a substantial amount of a strongly basic material.

* * * * *